US011111789B2

(12) United States Patent
Kim

(10) Patent No.: US 11,111,789 B2
(45) Date of Patent: Sep. 7, 2021

(54) VANE-TYPE AIR MOTOR

(71) Applicants: Shuiming Gong, Beijing (CN); Jae-Ho Kim, Beijing (CN)

(72) Inventor: Jae-Ho Kim, Beijing (CN)

(73) Assignees: Shuiming Gong, Beijing (CN); Jae-Ho Kim, Beijing (CN)

( * ) Notice: Subject to any disclaimer, the term of this patent is extended or adjusted under 35 U.S.C. 154(b) by 209 days.

(21) Appl. No.: 16/311,164

(22) PCT Filed: Jun. 25, 2017

(86) PCT No.: PCT/KR2017/006675
§ 371 (c)(1),
(2) Date: Dec. 19, 2018

(87) PCT Pub. No.: WO2017/222347
PCT Pub. Date: Dec. 28, 2017

(65) Prior Publication Data

US 2020/0182057 A1 Jun. 11, 2020

(30) Foreign Application Priority Data

Jun. 24, 2016 (KR) ..... 10-2016-0078952

(51) Int. Cl.
*F01C 1/344* (2006.01)
*F01C 21/02* (2006.01)
*F01C 21/08* (2006.01)

(52) U.S. Cl.
CPC ..... *F01C 1/3445* (2013.01); *F01C 1/344* (2013.01); *F01C 21/02* (2013.01);
(Continued)

(58) Field of Classification Search
CPC ..... F01C 1/3445; F01C 1/344; F01C 21/02; F01C 21/0836; F01C 21/0809;
(Continued)

(56) References Cited

U.S. PATENT DOCUMENTS 3,230,840 A * 1/1966 Hanson ..... F01C 1/3446 418/184
5,509,793 A * 4/1996 Cherry ..... F01C 1/3448 123/243

(Continued)

FOREIGN PATENT DOCUMENTS

CN 1267354 A 9/2000
CN 103498727 A 1/2014

(Continued)

*Primary Examiner* — Charles G Freay
(74) *Attorney, Agent, or Firm* — Oliff PLC

(57) ABSTRACT

The present invention provides a vane-type compressed air motor, comprising a casing, a rotor and vanes, wherein the casing is provided with an air inlet and an air outlet, a plurality of vanes are inserted into the rotor, and the rotor is disposed inside the casing to form a rotating body. The difference from the prior art is that the present invention further comprises a vane stopper, an inner retainer ring, stop bearings and a kit. Using the technique provided by the present invention, the wear of the vanes can be significantly reduced even under high pressure conditions, such that the service life of the vane is prolonged, air leakage is prevented, and the motor power can be improved. The present invention can also be used in various tools, having a significant effect of saving a lot consumption and cost, thereby having broad market prospects.

4 Claims, 5 Drawing Sheets

(52) U.S. Cl.
CPC ..... *F01C 21/0809* (2013.01); *F01C 21/0836* (2013.01); *F04C 2210/221* (2013.01); *F04C 2240/30* (2013.01)

(58) Field of Classification Search
CPC ..... F01C 21/0818; F01C 21/0854; F01C 18/3445; F01C 18/3447; F01C 18/332; F01C 18/46
USPC ..... 418/261, 264
See application file for complete search history.

(56) References Cited

U.S. PATENT DOCUMENTS

| | | | | |
|---|---|---|---|---|
| 5,524,587 | A * | 6/1996 | Mallen | F01C 1/3446 123/243 |
| 6,106,255 | A * | 8/2000 | Viegas | F01C 1/3442 418/152 |
| 7,695,261 | B2 * | 4/2010 | Patterson | F04C 2/3443 418/257 |
| 9,200,631 | B2 | 12/2015 | Beal | |
| 9,719,351 | B2 | 8/2017 | Landrum | |
| 2009/0223480 | A1 | 9/2009 | Sleiman et al. | |
| 2012/0260691 | A1 * | 10/2012 | Hirayama | F04C 18/3564 62/498 |

FOREIGN PATENT DOCUMENTS

| | | | | |
|---|---|---|---|---|
| CN | 203515794 | U | | 4/2014 |
| EP | 0465807 | A2 | * | 1/1992 |
| FR | 641155 | A | | 7/1928 |
| FR | 2458675 | A1 | | 1/1981 |
| GB | 508199 | A | | 6/1939 |
| JP | S53-59902 | A | | 5/1978 |
| JP | S5359902 | A | | 5/1978 |
| JP | H01-224490 | A | | 9/1989 |
| JP | H01224490 | A | | 9/1989 |
| JP | H03-185289 | A | | 8/1991 |
| JP | H03185289 | A | | 8/1991 |
| JP | H08-144701 | A | | 6/1996 |
| JP | 2008223731 | | * | 9/2008 |
| JP | 2008223731 | A | | 9/2008 |
| JP | 2009-041395 | A | | 2/2009 |
| JP | 2015-017612 | A | | 1/2015 |
| JP | 2015017612 | A | | 1/2015 |
| JP | 2015-222077 | A | | 12/2015 |
| JP | 2015222077 | A | | 12/2015 |
| KR | 2003-0072497 | A | | 9/2003 |
| RU | 2548522 | C2 | | 4/2015 |
| WO | 02101203 | A1 | | 12/2002 |

* cited by examiner

VANE-TYPE AIR MOTOR

CROSS REFERENCE TO RELATED APPLICATIONS

This application is the national phase entry of International Application No. PCT/KR2017/006675, filed on Jun. 25, 2017, which is based upon and claims priority to Korean Patent Application No. 10-2016-0078952, filed on Jun. 24, 2016, the entire contents of which are incorporated herein by reference.

TECHNICAL FIELD

The present invention belongs to the field of vane-type compressed air motors, and in particularly relates to the innovative technology involving a vane-type compressed air motor which can not only reduce wear of vanes and also improve the power of the motor when the motor is used under high pressure.

BACKGROUND

As shown in FIGS. 1 and 2, a typical vane-type compressed air motor is a device that, after high-pressure air A is injected, uses an expansion force from the air A to obtain a rotational force. Referring to FIG. 1, such a vane-type compressed air motor 1 is composed of a casing 10 with an air inlet 11 for injecting air A and an air outlet 13 for discharging the injected air A, and a cylindrical rotor 20 which is supported inside the casing 10 and rotates, the rotor 20 supporting a central shaft 30 which passes through the rotor so as to ensure smooth rotation of the casing 10. Further, an outer peripheral surface 23 of the rotor 20 is provided with grooves 25 which are formed in a lengthwise direction of the central shaft 30 and arranged in a direction towards the cylinder, and plate-shaped fins 40 which are inserted into the grooves 25 to reciprocate along the grooves 25, with a cylindrical surface (a surface formed in the direction towards the cylinder) being formed on an inner surface 15, in contact with outer distal end portions 41 of the fins 40, of the casing 10.

In addition, the center of the rotor 20 is of an eccentric structure with respect to the center of the inner surface 15. The air inlet 11 is formed in the casing 10 in a gradually enlarged manner in a state where the outer peripheral surface 23 of the rotor 20 is closest to the inner surface 15 of the casing 10, and the air outlet 13 is formed at a position where the outer peripheral surface 23 is furthest from the inner surface 15 or at a position closest to the supporting point. Operational embodiments of the vane-type compressed air motor 1 are described below.

Firstly, when high-pressure air A is injected into the air inlet 11, the air A enters a space between the fins 40 on two sides and between the inner surface 15 of the casing 10 and the outer peripheral surface 23 of the rotor 20. Therefore, the rotor 20 starts to rotate as the sealed air A expands.

In this way, in a state where the fins 40 protrude outwards under a centrifugal force, the fins gradually protrude more towards the inner surface 15. Therefore, the injected air A serves to make the volume become larger and larger. Reference is made to FIG. 2 for the principle of rotating the rotor 20 by means of the injected air A. In the inner side surfaces L, K of the two corresponding fins 40, the area of the inner side surface K in the rotation direction is larger than that of the other inner surface. This is a normal phenomenon caused by the eccentric structure of the rotor

20 in the casing 10. Therefore, the expansion force of the air will apply a side thrust F to the inner surface K in the rotation direction. Strictly, the side thrust F is a difference between side thrusts acting on the inner side surfaces L, K, and the expansion force of the air A acts on the inner surface 15 and the outer peripheral surface 23 at the same time, such that the inner surface 15 between the two fins 40 is of course wider than the outer peripheral surface 23 between the two fins 40. Therefore, the thrust P acts in a direction towards the casing 10. At this time, the thrust P pushes the inner surface 15, and cannot act as a rotational force for rotating the rotor 20 together with the side thrust F since the casing 10 is fixed instead of being rotatable.

Therefore, the rotor 20 can only be rotated by the side thrust F. Of course, since the high-pressure air A is injected into spaces between most of the fins 40, the force for rotating the rotor 20 is a multiple of the side thrust F, and in this way, the expanded air A is impelled by the rotating fins 40 and is then discharged via the air outlet 13.

Further, the fins 40 are inserted into the grooves 25 of the rotor 20 while moving towards the inner surface 15 of the casing 10 as the rotor 20 rotates.

With such cycle, the air A continuously and repeatedly enters the spaces between the fins 40 such that the rotor 20 rotates continuously, and the rotational forces are finally used as power.

However, in the above conventional technologies, since the fins rub due to the high-speed rotation thereof, the output is reduced, and the durability of the fins is reduced due to the wear.

SUMMARY OF THE INVENTION

In order to solve the problems in the conventional technologies, an object of the present invention is to provide a vane-type compressed air motor which can reduce the wear caused by the rubbing of vanes even when used under high pressure, thereby prolonging its service life. Moreover, it is to provide a novel vane-type compressed air motor which can maximally prevent air leakage and thus increase the power.

In order to achieve the objects of the present invention, the following technical solutions of the vane-type compressed air motor according to the present invention are provided.

A vane-type compressed air motor, including: a casing with an air inlet and an air outlet; a rotor; and a plurality of vanes, the plurality of vanes being inserted into the rotor to form a rotating body rotatable around a central axis and the rotating body being disposed inside the casing; vane stoppers respectively disposed on two axial sides of each of the plurality of vanes adjacent to a radially inner end of each of the plurality of vanes; an inner retainer ring disposed on an axial side of the rotor while being arranged eccentrically relative to the central axis of the rotating body, wherein an outer surface of the inner retainer ring pushes the vane stopper on a corresponding axial side of each of the plurality of vanes towards a direction away from the central axis of the rotating body; bearing rings respectively disposed on two axial sides of the rotor to restrict the movement of vane stoppers towards a direction away from the central axis of the rotating body; and a kit composed of two covers respectively disposed at two axial sides of the rotor, each of the two covers being provided with guide grooves on a side facing the rotating body and the plurality of vanes being movable within the guide grooves, wherein axially extending air grooves are formed on both side surfaces of each of the plurality of vanes adjacent to a radially outer end of each of the plurality of vanes, the side surfaces including an upstream side surface and a downstream side surface in the rotation direction of the rotating body.

The vane-type compressed air motor can further include an axially extending insertion groove that is provided at the radially outer end of each of the plurality of vanes, and a vane roller is inserted into the insertion groove.

A vane-type compressed air motor, including: a casing with an air inlet and an air outlet; a rotor; a plurality of vanes, the plurality of vanes being inserted into the rotor to form a rotating body rotatable around a central axis and the rotating body being disposed inside the casing; vane stoppers respectively disposed on two axial sides of each of the plurality of vanes adjacent to a radially inner end of each of the plurality of vanes; an inner retainer ring disposed on an axial side of the rotor while being arranged eccentrically relative to the central axis of the rotating body, wherein an outer surface of the inner retainer ring pushes the vane stopper on a corresponding axial side of each of the plurality of vanes towards a direction away from the central axis of the rotating body; bearing blocks sleeved on the vane stoppers with inner grooves formed in the casing to receive the bearing blocks respectively at two axial sides of the rotor to restrict the movement of vane stoppers towards a direction away from the central axis of the rotating body; and a kit composed of two covers respectively disposed at two axial sides of the rotor, each of the two covers being provided with guide grooves on a side facing the rotating body and the plurality of vanes being movable within the guide grooves, wherein axially extending air grooves are formed on both side surfaces of each of the plurality of vanes adjacent to a radially outer end of each of the plurality of vanes, the side surfaces including an upstream side surface and a downstream side surface in the rotation direction of the rotating body.

The vane-type compressed air motor can further include an axially extending insertion groove that is provided at the radially outer end of each of the plurality of vanes, and a vane roller is inserted into the insertion groove.

According to the present invention, the wear caused by rubbing of the vane can be minimized even under high pressure conditions, and therefore, not only the service life of the vane can be prolonged, but also the present invention can be used in various tools in which air is used, exhibiting a significant effect of saving the consumption and cost, thereby having a broad market prospect.

In addition, according to the present invention, air leakage can also be prevented, and insertion grooves are formed in an outer peripheral surface of the rotor, thereby having the effect of improving the power of the motor.

REFERENCE NUMERALS IN FIGS. 3 TO 9

Figure 1:
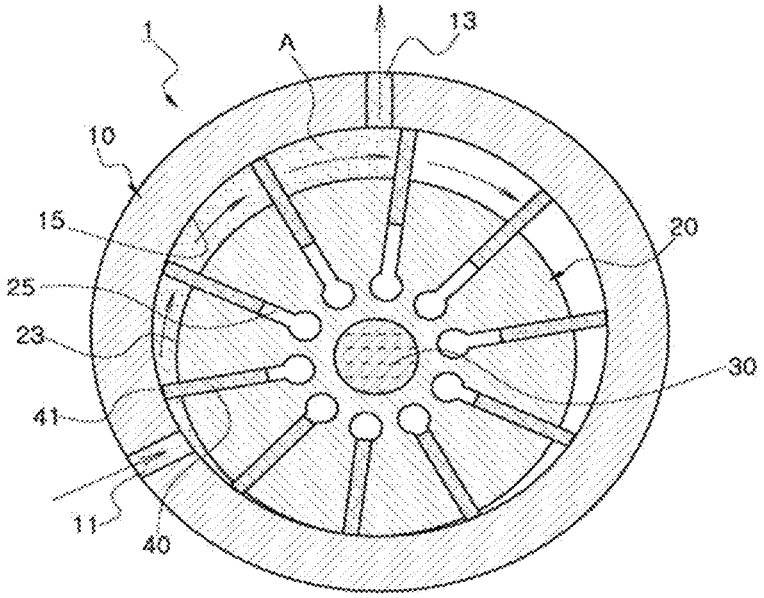
FIG. 1 (Prior Art)
FIG. 1 is a cross-sectional view of a vane-type air motor according to the conventional technologies.
Figure 2:
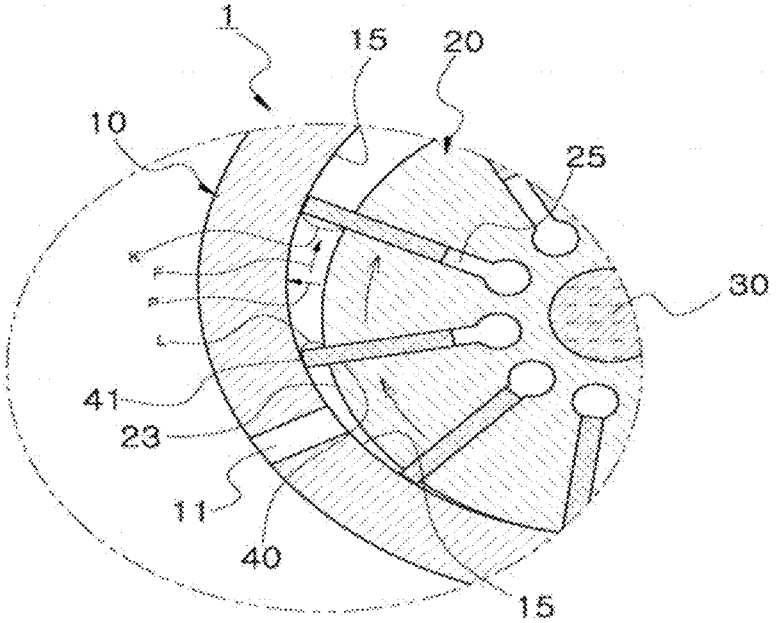
FIG. 2 (Prior Art)
FIG. 2 is an enlarged partial view of FIG. 1.
Figure 3:
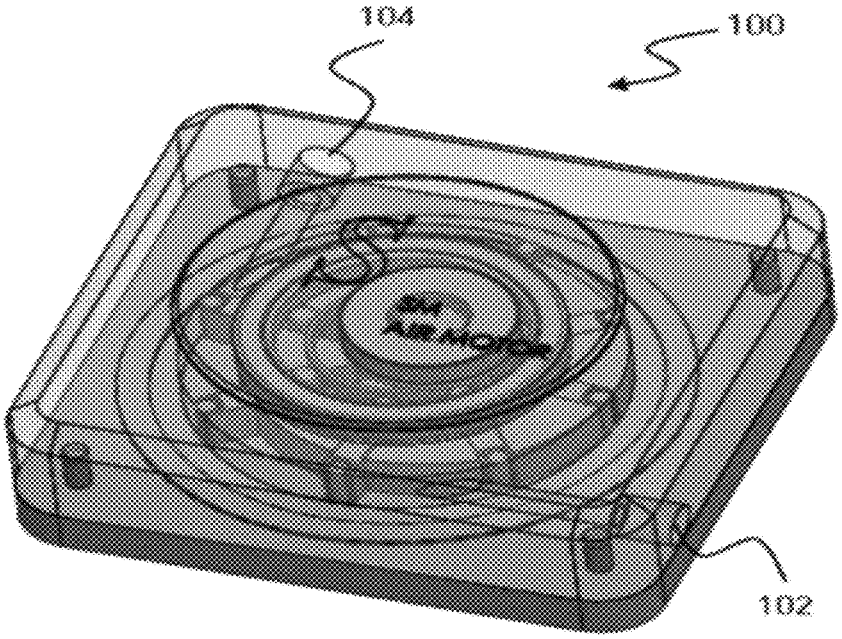
FIG. 3 is a transparent oblique view of a vane-type compressed air motor according to an embodiment of the present invention.

100. vane-type compressed air motor 106. casing 102. air inlet 104. air outlet
110. rotor 120. inner retainer ring
130. vane roller 131 insertion groove 135. guide groove 140. vane stopper 145. vane 145*a*. air groove 145*b*. outer end 150. kit 150*a*. upper cover
150*b*. lower cover 160*a*. first stop bearing (bearing ring) 160*b*. second stop bearing (bearing block) 170. inner groove

DETAILED DESCRIPTION OF EMBODIMENTS

An embodiment of a vane-type compressed air motor 100 according to the present invention will be described in detail below according to FIGS. 3 to 9.

Referring to FIGS. 3 to 6 and FIG. 8, a vane-type compressed air motor 100 provided by an embodiment of the present invention, which is a device that, after high-pressure air is injected, use a thrust force of the air to obtain a rotational force, comprises a casing 106, a rotor 110 and vanes 145, the casing 106 being provided with an air inlet 102 and an air outlet 104, eight vanes 145 being inserted into the rotor 110, and the rotor being disposed inside the casing 106 to form a rotating body rotatable around a central axis. The difference from the conventional technologies is: the present embodiment further comprises vane stoppers 140, an inner retainer ring 120, first stop bearings 160*a* (bearing rings) and a kit 150.

The vane stoppers 140 are respectively disposed on two axial sides of each of the plurality of vanes 145 adjacent to a radially inner end of each of the plurality of vanes 145, and the first stop bearings 160*a* are respectively mounted on upper and lower portions of the rotor 110 to restrict movement of the vane, so as to achieve the purpose of restricting the vanes 145 from moving outwards relative to the inner retainer ring. The vane stopper 140 may be formed in the shape of a bearing to minimize contact, friction and wear with the first stop bearings 160*a*.

The inner retainer ring 120 is disposed on an axial side of the rotor 110 while being arranged eccentrically relative to the central axis of the rotating body, with an outer surface thereof pushing the vane stopper 140 on a corresponding axial side of each of the plurality of vanes 145 towards a direction away from the central axis of the rotating body. The rotor 110 supports a central shaft which passes therethrough, so as to ensure smooth rotation in the casing 106. When the driving is initiated, the inner ring has the function to push the vane stopper 140 outwards so as to ensure the vane 145 to move outwards to achieve the purpose of an initial activation. That is, the inner ring 120 has an eccentric structure, and when the driving is initiated, a pressure is applied outwards on the vane stopper 140 so that the inwardly-drawn vane 145 protrudes outwards to achieve a successful driving of the vane-type compressed air motor 100 according to the present invention.

The first stop bearings 160*a* are respectively disposed on two axial sides of the rotor 110 to restrict the movement of vane stoppers 140 towards a direction away from the central axis of the rotating body, such that the vane stoppers 140 rotate only in a certain trajectory to prevent the vanes 145 from moving outwards and coming into contact with the inner wall of the casing 106 to generate friction and wear.

The kit 150 is composed of an upper cover 150*a* and a lower cover 150*b* (two covers) respectively disposed at two axial sides of the rotor 110, and the kit 150 functions to prevent air leakage when the motor operates. Each of the upper cover 150*a* and the lower cover 150*b* are provided with guide grooves 135 on a side facing the rotating body, and the vanes 145 are movable within the guide grooves 135.

Figure 6:
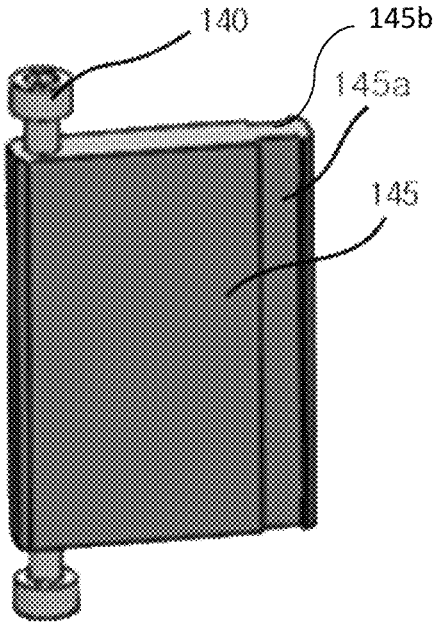
FIG. 6 is a perspective view showing a relationship between a vane and a vane stopper of a vane-type compressed air motor according to the present invention.
Figure 7:
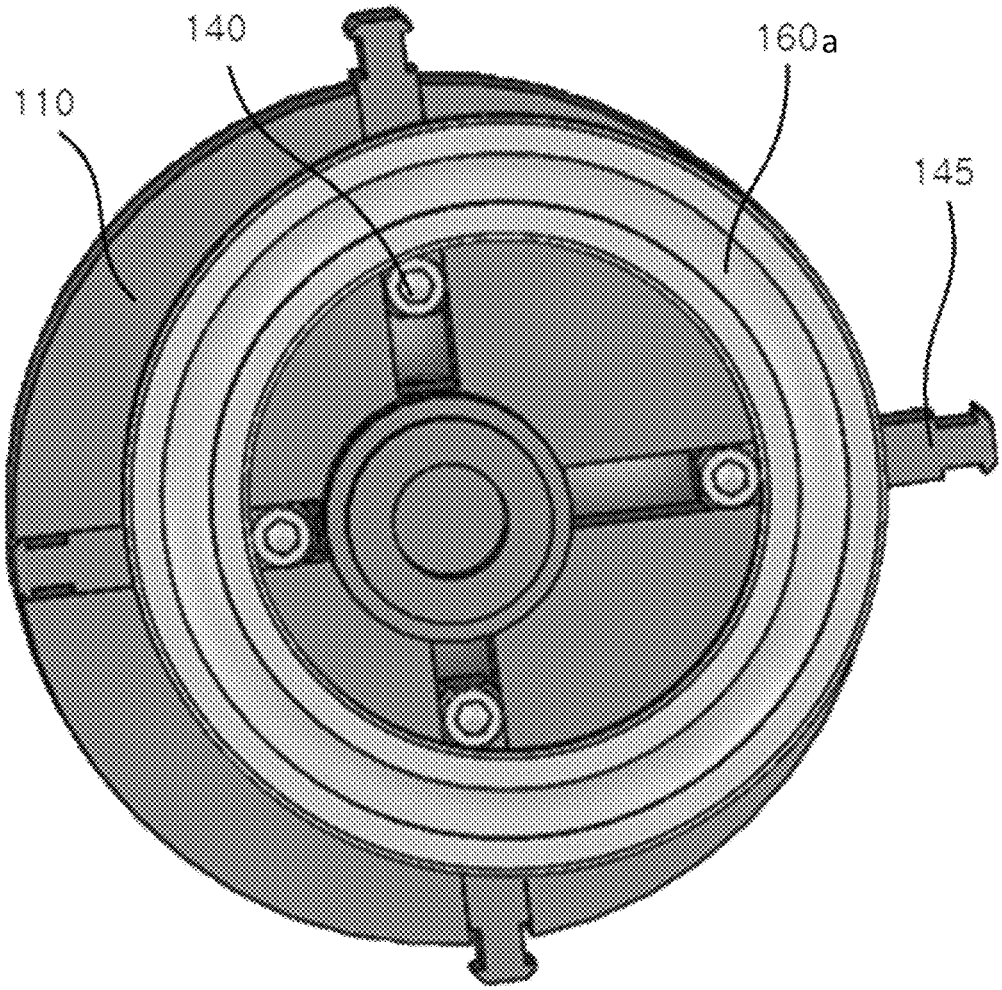
FIG. 7 is a perspective view showing an action relationship between a vane stopper and a first stop bearing of a vane-type compressed air motor according to the present invention.
Figure 8:
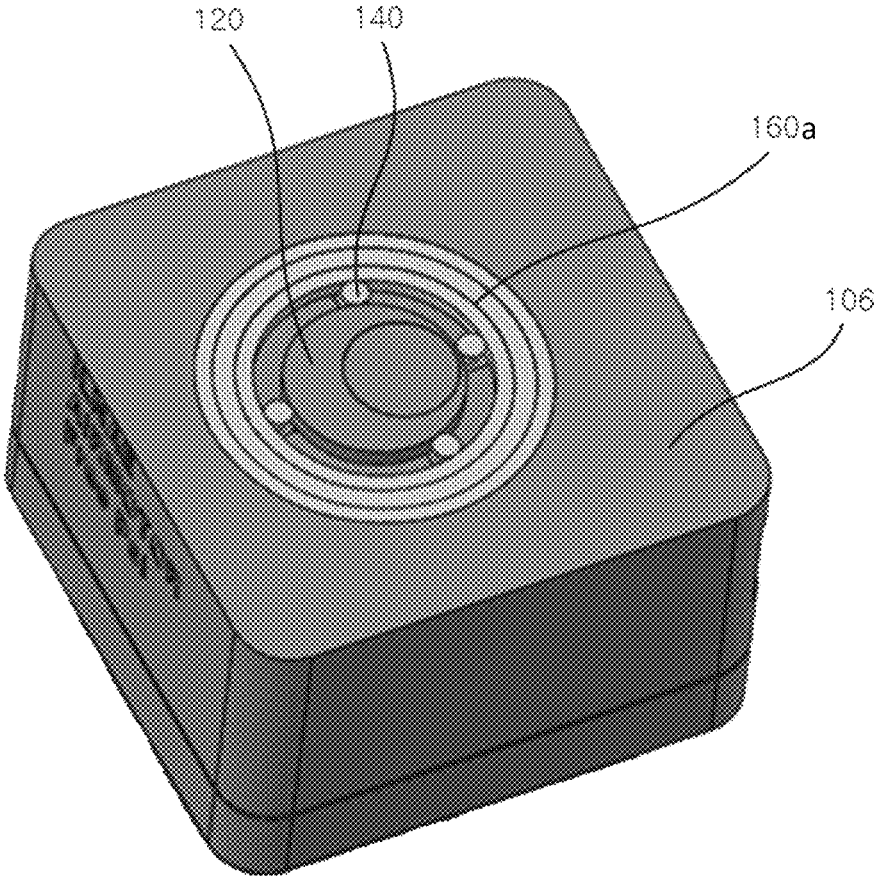
FIG. 8 is a perspective view showing an assembled state of a vane-type compressed air motor according to an embodiment of the present invention.

As shown in FIGS. 6-7, in the driving process of the compressed air motor 100, the vane 145 will tend to be drawn inwards due to the air pressure supplied by the high pressure when the vane 145 rotates at a high speed, and at this time, the high-pressure air may leak out through a gap between the end portion of the vane 145 and the inner wall of the casing 106, which will result in reducing the power. So in this embodiment, axially extending air grooves 145*a* are formed on both side surfaces of the vane 145 adjacent to a radially outer end of the vane 145, the side surfaces including an upstream side surface and a downstream side surface in the rotation direction of the rotating body. In this case, a force for preventing the vane 145 from being drawn inwards may be generated in response to the air pressure acting on the air grooves 145*a*, thereby eventually preventing the output power of the compressed air motor 100 from being reduced.

Figure 4:
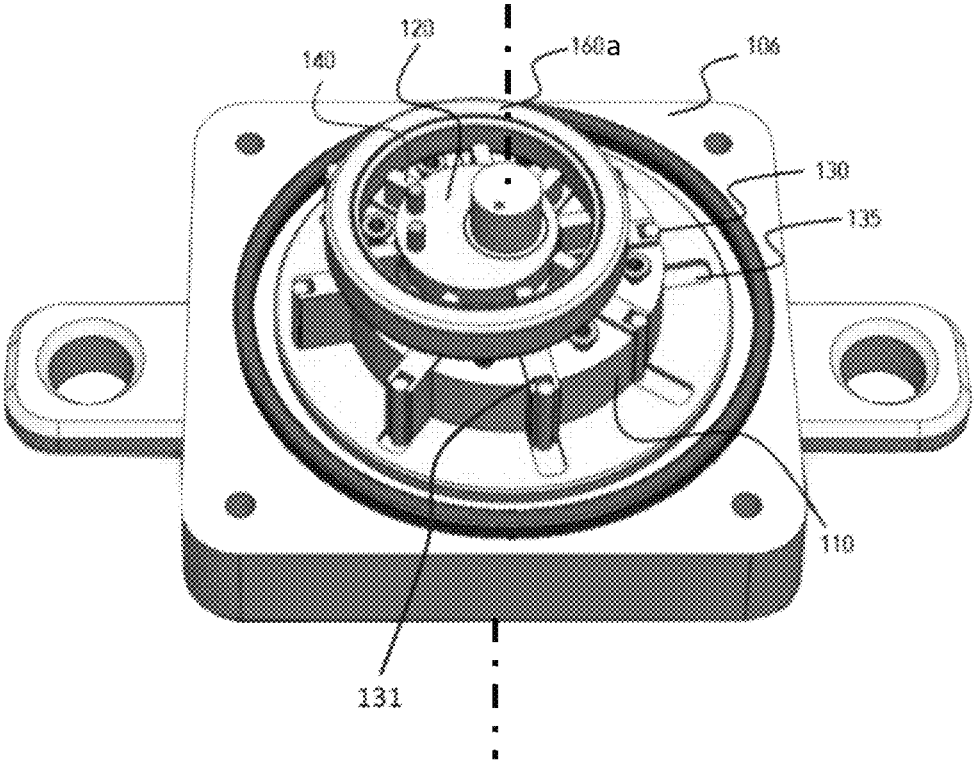
FIG. 4 is a perspective view of a vane-type compressed air motor according to an embodiment of the present invention.
Figure 5:
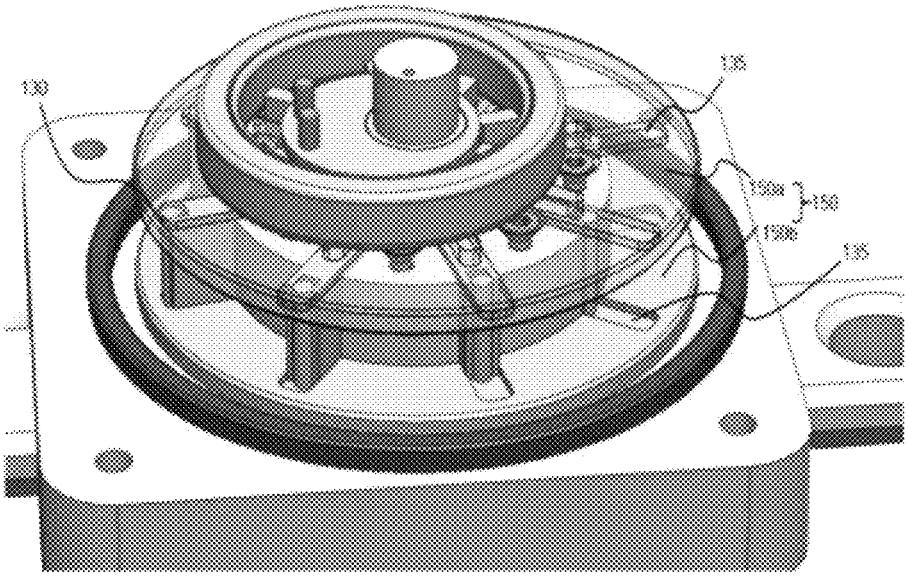
FIG. 5 is a perspective view of a vane-type compressed air motor according to an embodiment of the present invention when installed with a kit.

As shown in FIG. 4, an axially extending insertion groove 131 is provided at the radially outer end of each of the plurality of vanes 145, and a vane roller 130 may be inserted into the insertion groove 131 to reduce the friction and wear of vanes due to contact between the vanes 145 and the casing 106 as the motor rotates. The vane rollers 130 may be of various shapes, such as a cylindrical shape and a square column shape.

Figure 9:
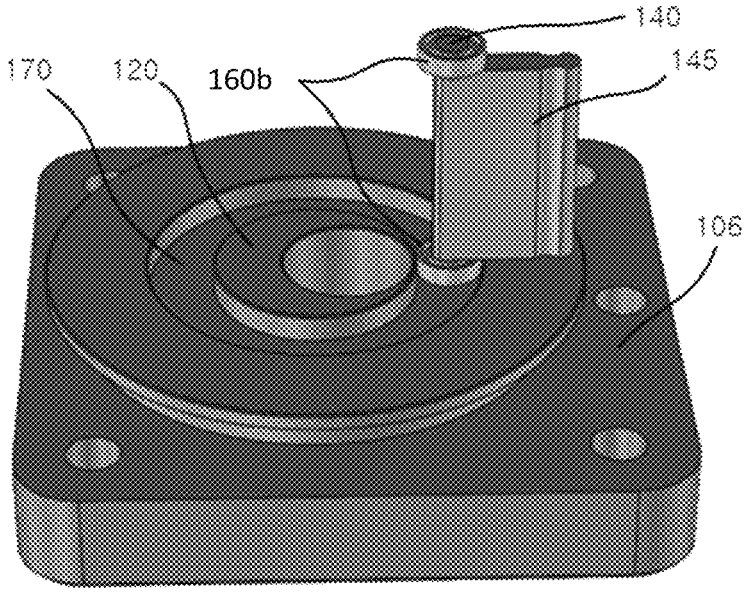
FIG. 9 is a perspective view of a vane-type compressed air motor according to another embodiment of the present invention, with some structural components omitted so as to not obscure the illustration.

As shown in FIG. 9, another embodiment of the present invention is provided, different in that an inner groove 170 is provided inside the casing 106, the second stop bearings 160*b* (bearing blocks) are inserted over the vane stopper 140 and inserted into the inner groove 170, and the plurality of vanes in the rotor 110 are circumferentially rotated along the inner groove 170. In this embodiment, an outer side of the vane stopper 140 is directly connected to the second stop bearings 160*b*, and an inner groove 170 having the same shape as the first stop bearings 160*a* in the foregoing embodiment is formed at an inner side of the casing 106 so as to prevent the vanes 145 from moving outwards and coming into contact with the inner wall of the casing 106 to generate friction and wear. The inner portion of the casing 106 may be oval in shape, and an air inlet 102 and an air outlet 104 may be mounted on two sides. That is, second stop bearings 160*b* are sleeved on the vane stoppers 140 with inner grooves 170 formed in the casing 106 to receive the second stop bearings 160*b* respectively at two axial sides of the rotor 110 to restrict the movement of vane stoppers 140 towards a direction away from the central axis of the rotating body.

In addition, another shaft may be mounted on the side of the air outlet 104, and the two shafts may be connected by gears or belts to form an internal gear.

The outer peripheral surface of the rotor 110 may be formed in a lengthwise direction toward the central shaft in a way of protruding in the cylindrical direction. In addition, in order to increase the power of the motor, insertion grooves are preferably formed on the outer peripheral surface of the rotor 110.

The present invention is not limited to the preferred embodiments with aforementioned features, and changes may be made to the present invention by those skilled in the art without departing from the scope of the appended claims. Therefore, various changes made to these embodiments will fall within the scope of protection of the present invention.

INDUSTRIAL APPLICABILITY

The present invention relates to the field of vane-type compressed air motors, and in particularly to the innovative technology involving a vane-type compressed air motor which can not only reduce wear of a vane and also improve the power of the motor when the motor is used under high pressure.

What is claimed is:

1. A vane-type compressed air motor, comprising:

a casing with an air inlet and an air outlet;

a rotor;

a plurality of vanes, the plurality of vanes being inserted into the rotor to form a rotating body rotatable around a central axis and the rotating body being disposed inside the casing;

vane stoppers respectively disposed on two axial sides of each of the plurality of vanes adjacent to a radially inner end of each of the plurality of vanes;

an inner retainer ring disposed on an axial side of the rotor while being arranged eccentrically relative to the central axis of the rotating body, wherein an outer surface of the inner retainer ring pushes the vane stopper on a corresponding axial side of each of the plurality of vanes towards a direction away from the central axis of the rotating body;

bearing rings respectively disposed on two axial sides of the rotor to restrict the movement of vane stoppers towards a direction away from the central axis of the rotating body; and a kit composed of two covers respectively disposed at two axial sides of the rotor, each of the two covers being provided with guide grooves on a side facing the rotating body and the plurality of vanes being movable within the guide grooves, wherein axially extending air grooves are formed on both side surfaces of each of the plurality of vanes adjacent to a radially outer end of each of the plurality of vanes, the side surfaces including an upstream side surface and a downstream side surface in the rotation direction of the rotating body.

2. The vane-type compressed air motor according to claim 1, wherein an axially extending insertion groove is provided at the radially outer end of each of the plurality of vanes, and a vane roller is inserted into the insertion groove.

3. A vane-type compressed air motor, comprising:

a casing with an air inlet and an air outlet;

a rotor;

a plurality of vanes, the plurality of vanes being inserted into the rotor to form a rotating body rotatable around a central axis and the rotating body being disposed inside the casing;

vane stoppers respectively disposed on two axial sides of each of the plurality of vanes adjacent to a radially inner end of each of the plurality of vanes;

an inner retainer ring disposed on an axial side of the rotor while being arranged eccentrically relative to the central axis of the rotating body, wherein an outer surface of the inner retainer ring pushes the vane stopper on a corresponding axial side of each of the plurality of vanes towards a direction away from the central axis of the rotating body;

bearing blocks sleeved on the vane stoppers with inner grooves formed in the casing to receive the bearing blocks respectively at two axial sides of the rotor to restrict the movement of vane stoppers towards a direction away from the central axis of the rotating body; and a kit composed of two covers respectively disposed at two axial sides of the rotor, each of the two covers being provided with guide grooves on a side facing the rotating body and the plurality of vanes being movable within the guide grooves, wherein axially extending air grooves are formed on both side surfaces of each of the plurality of vanes adjacent to a radially outer end of each of the plurality of vanes, the side surfaces including an upstream side surface and a downstream side surface in the rotation direction of the rotating body.

4. The vane-type compressed air motor according to claim 3, wherein an axially extending insertion groove is provided at the radially outer end of each of the plurality of vanes, and a vane roller is inserted into the insertion groove.

* * * * *